US005882755A

United States Patent [19]

Igarashi et al.

[11] Patent Number: 5,882,755

[45] Date of Patent: Mar. 16, 1999

[54] TACK SHEET FOR INK JET RECORDING

[75] Inventors: Koji Igarashi; Susumo Ogawa; Hirokazu Ohkura; Takashi Kikuchi; Hideaki Senoo, all of Tokyo, Japan

[73] Assignee: Mitsubishi Paper Mills Limited, Tokyo, Japan

[21] Appl. No.: 909,584

[22] Filed: Aug. 12, 1997

Related U.S. Application Data

[63] Continuation of Ser. No. 398,665, Mar. 3, 1995, abandoned.

[30] Foreign Application Priority Data

| | | | |
|---|---|---|---|
| Mar. 4, 1994 | [JP] | Japan | 6-035025 |
| Mar. 4, 1994 | [JP] | Japan | 6-035030 |
| Jan. 12, 1995 | [JP] | Japan | 7-003180 |

[51] Int. Cl.[6] ..... B41M 5/00

[52] U.S. Cl. ..... 428/41.8; 428/42.1; 428/145; 428/343; 428/352; 428/354

[58] Field of Search ..... 428/195, 41.8, 428/42.1, 343, 352, 354

[56] References Cited

U.S. PATENT DOCUMENTS

| | | | |
|---|---|---|---|
| 5,165,973 | 11/1992 | Kojima et al. | 428/195 |
| 5,472,757 | 12/1995 | Ogawa et al. | 428/211 |

FOREIGN PATENT DOCUMENTS

| | | |
|---|---|---|
| 0 379 964 | 1/1990 | European Pat. Off. . |
| 60-11389 | 1/1985 | Japan . |
| 62-238783 | 10/1987 | Japan . |
| 1-9776 | 1/1989 | Japan . |
| 1-77572 | 3/1989 | Japan . |
| 4-223190 | 8/1992 | Japan . |
| 4-341885 | 11/1992 | Japan . |

OTHER PUBLICATIONS

Properties of Paper: An Introduction, 1989, pp. 60 & 106, William E. Scott, et al.

Dry Strength Additives, 1980, pp. 106–123.

Database WPI, Derwent Publications, AN–94–307439, JP–6–234267, Aug. 23, 1994.

Database WPI, Derwent Publications, AN–92–418286, JP–4–311786, Nov. 4, 1992.

*Primary Examiner*—Pamela R. Schwartz
*Attorney, Agent, or Firm*—Oblon, Spivak, McClelland, Maier & Neustadt, P.C.

[57] ABSTRACT

A tack sheet for ink jet recording, which comprises an ink jet recording sheet having at least one ink-receiving layer formed on one side of a support and an adhesive layer formed on the other side of the support, and a release sheet integrated thereto to cover the adhesive layer, wherein a cationic polymer is contained or impregnated in at least one of the support and the ink-receiving layer, and the ink jet recording sheet has an internal bond strength of from 120 to 320 g·cm/cm$^2$ as measured in a wet state after being immersed in water at 20° C. for 10 seconds, in accordance with TAPPI USEFUL METHODS NO. 403.

23 Claims, No Drawings

TACK SHEET FOR INK JET RECORDING

This application is a continuation of application Ser. No. 08/398,665, filed on Mar. 3, 1995, now abandoned.

The present invention relates to a tack sheet for ink jet recording, which can be printed with an ink. Particularly, it relates to a tack sheet for ink jet recording, suitable for full color ink jet recording, which is characterized in that particularly when printing is carried out with a water-color ink, it not only provides excellent release performance to the release sheet but also secures high ink absorptivity, even when the tack sheet is subjected to moisture condensation or accidental absorption of water, and which is excellent in the water resistance, image density and clarity of recorded images.

An ink jet recording system is a system whereby fine droplets of ink are jetted and deposed on the recording sheet such as a paper sheet to record images or letters by various operational principles, and it has features such as high speed and no noise and such that multicoloring is easy, flexibility for various recording patterns is high, and no development or fixing is required. Such an ink jet recording system has been used for various applications as recording apparatus for various patterns including Chinese characters and for color images. Further, with respect to an image formed by a multi-color ink jet system, it is possible to obtain a record comparable with a printed image by a multi-color photographic system by plate-making system. Further, in a case where the number of copies is relatively small, the ink jet recording system is inexpensive as compared with the photographic system, and it is accordingly widely applied even to the full color image recording field. Further, as an attempt to reconsider the ink composition, an ink jet recording system using a pigment ink has been devised and practically used. However, in most cases, an ink jet recording system still employs a water-soluble dye.

As the recording sheet to be used for this ink jet recording system, in an attempt to use wood free paper or coated paper which is commonly used for printing or writing, various studies have been made with respect to the apparatus and the ink composition. However, as a result of improvements in the performance of ink jet recording apparatus and expansion of the applications, such as the progress in high speed of the apparatus, the progress in high precision recording or the progress in the full color recording, the recording sheet is also required to have high levels of the following properties.

(1) The recorded dot density and the image density must be high.

(2) The color effect and clarity of the images must be good.

(3) The printed dot shapes must be good.

(4) The ink absorption must be good.

(5) The image storage stability such as the water resistance, light resistance and ozone resistance of the recorded images must be good.

(6) In the case of the coated type recording sheet, the adhesion of the coating layer must be high, and falling of the power must be little.

To satisfy such requirements, some proposals have been made heretofore. For example, there have been proposed a method of providing an ink-receiving layer on a support to improve the ink absorption or to improve the printed dot shape (Japanese Unexamined Patent Publications No. 9074/1977 and No. 144172/1983), and a method of using a specific agent to absorb the dye component taking into consideration the fact that the distribution of the dye component in the ink in the ink-receiving layer influences over the color effect and the clarity (Japanese Unexamined patent Publication No. 144172/1980).

Further, there have been proposed a method of impregnating a polycationic polymer electrolyte to the surface to improve the water resistance (Japanese Unexamined patent Publication No. 84992/1981), and a method for providing water resistance by forming a chelate with a dye in a water-soluble ink (Japanese Unexamined Patent Publication No. 150396/1980). Furthermore, it has been proposed to incorporate a basic oligomer in order to improve the water resistance, the light resistance and the ozone resistance simultaneously (Japanese Unexamined Patent Publication No. 11389/1985) or to use a polyvinyl amine copolymer in the substrate or in the coating layer on the substrate (Japanese Unexamined Patent Publication No. 8085/1989).

However, the requirements for such properties tend to be increasingly higher and severer, while an ink jet recoding apparatus has become inexpensive. Yet, an image excellent in the image reproducibility and color reproducibility, such as the clarity and the color effect, can readily be obtained at a personal computer level. Accordingly, the ink jet recording apparatus has changed from a special recording apparatus used by a special person to a recording apparatus commonly used, and the obtainable image tends to be indistinguishable from a printed or photographed image. Accordingly, it has been difficult to fully solve the problems involved in the ink jet recording system, such as the ink absorption, the water resistance, the light resistance and the ozone resistance. Accordingly, it is now essential for an ink jet recording apparatus or an ink jet recording sheet to secure such properties.

Further, due to the diversification of uses, it has been common to use an ink jet recording sheet for a poster or POP art, or to provide an adhesive layer on its rear side to form a self-adhesive label such as a price indication label, a product identification (bar code) label, a quality indication label and the amount indication label or an advertisement label (sticker). Especially for a bar code label, the high definition of an ink jet recording sheet can be utilized, and for an advertisement label an excellent image can be obtained since the ink jet recording sheet is excellent in the definition and color effect, and the advertisement effect will be substantial. For such an application, it is readily possible to obtain images excellent in the image reproducibility or the color reproducibility, such as in the definition or the color effect, of a personal computer level. This is a reason why ink jet recording sheets have been widely used. Especially when they are treated to have self-adhesive properties, they can be made to well adhere to a wide range of objects, whereby the attaching operation will be simple, and it will be possible to impart a composite function by laminating a sheet having a heat sensitive property, a magnetic property or an off-set printing property by means of an adhesive layer on the other side. Accordingly, its application to tickets, commutation passes or various cards has been expanded.

However, the ink used for ink jet recording is conventional water-color ink employing a direct dye or an acid dye and therefore has a drawback that it is inferior in water resistance of the recorded image. Japanese Unexamined Patent Publications No. 223190/1992 and No. 341885/1992 disclose labels for ink jet recording having the water resistance improved. Such labels are improved in that when the recorded image is immersed in water, running of ink is prevented, but the improvement is not good enough to prevent deterioration of the image quality due to smudging of the recorded image.

Further, in the case of an ink jet recording sheet wherein the support is made essentially of wood pulp, if an adhesive layer is provided simply for self-adhesion, the peel strength and the adhesive strength between the adhesive layer and the rear side of the ink jet recording sheet will increase due to swelling of the adhesive of the adhesive layer when printed with water-color ink or when wetted with water, whereby the value as label paper will be lost such that the adhesive layer tends to transfer to the release sheet when the release sheet is peeled, the support of the ink jet recording sheet tends to undergo ply separation and the labeler applicability tends to be poor. This hinders development of a sheet having composite functions by lamination or development of the above mentioned application to labels.

Under these circumstances, it is an object of the present invention to provide a tack sheet for ink jet recording, which secures a high level of ink absorption and is excellent in the water resistance, image density and clarity of the image formed by ink jet recording and which, at the same time, provides excellent peeling properties to the release sheet when printing is conducted with water-color ink or even when the sheet is subjected to moisture condensation or accidental absorption of water.

The present inventors have conducted an extensive research to accomplish the above object and, as a result, have finally invented a tack sheet for ink jet recording whereby smooth peeling between the release sheet and the adhesive layer of the ink jet recording sheet can be ensured without ply separation of the support portion even in a wet state and a high level of ink absorption can be secured, and which is excellent in the water resistance, image density and clarity.

Namely, in its first aspect, the present invention provides a tack sheet for ink jet recording, which comprises an ink jet recording sheet having at least one ink-receiving layer formed on one side of a support and an adhesive layer formed on the other side of the support, and a release sheet integrated thereto to cover the adhesive layer, wherein a cationic polymer is contained or impregnated in at least one of the support and the ink-receiving layer, and the ink jet recording sheet has an internal bond strength of from 120 to 320 g·cm/cm$^2$ as measured in a wet state after being immersed in water at 20° C. for 10 seconds, in accordance with TAPPI USEFUL METHODS NO. 403.

In the tack sheet for ink jet recording according to the first aspect of the present invention, the water immersion peel strength between the adhesive layer of the ink jet recording sheet in a wet state and the release sheet is preferably from 6 to 50 g/3 cm, as stipulated in JIS Z0237-1980.

Likewise, in the tack sheet for ink jet recording according to the first aspect of the present invention, the water absorption degree of the ink jet recording sheet is preferably at least 110 wt % of the weight of the ink recordable per unit area, as stipulated in JIS P8140.

Further, in the tack sheet for ink jet recording according to the first aspect of the present invention, it is preferred that the cationic polymer is at least one member selected from the group consisting of a polycondensate of dicyandiamide and a polyvinyl amine.

Furthermore, in the tack sheet for ink jet recording according to the first aspect of the present invention, the adhesive layer is preferably composed of a solvent-type adhesive.

In its second aspect, the present invention provides a tack sheet for ink jet recording, which comprises an ink jet recording sheet having at least one ink-receiving layer formed on one side of a support and an adhesive layer formed on the other side of the support, and a release sheet integrated thereto to cover the adhesive layer, wherein a cationic polymer is contained or impregnated in at least one of the support and the ink-receiving layer, the ink jet recording sheet has an internal bond strength of from 145 to 300 g·cm/cm$^2$ as measured in a wet state after being immersed in water at 20° C. for 10 seconds, in accordance with TAPPI USEFUL METHODS NO. 403, and the water immersion peel strength between the adhesive layer and the release sheet is from 12 to 44 g/3 cm, as stipulated in JIS Z0237/1980.

In the tack sheet for ink jet recording according to the second aspect of the present invention, the water absorption degree of the ink jet recording sheet is preferably at least 110 wt % of the weight of the ink recordable per unit area, as stipulated in JIS P8140.

Likewise, in the tack sheet for ink jet recording according to the second aspect of the present invention the cationic polymer is preferably at least one member selected from the group consisting of a polycondensate of dicyandiamide and a polyvinyl amine.

Further, in the tack sheet for ink jet recording according to the second aspect of the present invention, the adhesive layer is preferably composed of a solvent-type adhesive.

In its third aspect, the present invention provides a tack sheet for ink jet recording, which comprises an ink jet recording sheet having at least one ink-receiving layer formed on one side of a support and an adhesive layer formed on the other side of the support, and a release sheet integrated thereto to cover the adhesive layer, wherein a cationic polymer is contained or impregnated in at least one of the support and the ink-receiving layer, the ink jet recording sheet has an internal bond strength of from 170 to 280 g·cm/cm$^2$ as measured in a wet state after being immersed in water at 20° C. for 10 seconds, in accordance with TAPPI USEFUL METHODS NO. 403, the water immersion peel strength between the adhesive layer and the release sheet is from 18 to 38 g/3 cm, as stipulated in JIS Z0237/1980, and the water absorption degree of the ink jet recording sheet is at least 110 wt % of the weight of the ink recordable per unit area, as stipulated in JIS P8140.

In the tack sheet for ink jet recording according to the third aspect of the present invention, the cationic polymer is preferably at least one member selected from the group consisting of a polycondensate of dicyandiamide and a polyvinyl amine.

Likewise, in the tack sheet for ink jet recording according to the third aspect of the present invention, the adhesive layer is preferably composed of a solvent-type adhesive.

In its fourth aspect, the present invention provides a tack sheet for ink jet recording, which comprises an ink jet recording sheet having at least one ink-receiving layer formed on one side of a support and an adhesive layer formed on the other side of the support, and a release sheet integrated thereto to cover the adhesive layer, wherein a cationic polymer is contained or impregnated in at least one of the support and the ink-receiving layer, the ink jet recording sheet has an internal bond strength of from 170 to 280 g·cm/cm$^2$ as measured in a wet state after being immersed in water at 20° C. for 10 seconds, in accordance with TAPPI USEFUL METHODS NO. 403, and the water absorption degree of the ink jet recording sheet is at least 110 wt % of the weight of the ink recordable per unit area, as stipulated in JIS P8140.

In the tack sheet for the ink jet recording according to the fourth aspect of the present invention, the water immersion peel strength between the adhesive layer of the ink jet recording sheet in a wet state and the release sheet is preferably from 6 to 50 g/3 cm, as stipulated in JIS Z0237/1980.

Likewise, in the tack sheet for ink jet recording according to the fourth aspect of the present invention, the cationic polymer is preferably at least one member selected from the group consisting of a polycondensate of dicyandiamide and a polyvinyl amine.

Further, in the tack sheet for ink jet recording according to the fourth aspect of the present invention, the adhesive layer is preferably composed of a solvent-type adhesive.

In its fifth aspect, the present invention provides an ink jet recording method for a tack sheet for ink jet recoding, which tack sheet comprises an ink jet recording sheet having at least one ink-receiving layer formed on one side of a support and an adhesive layer formed on the other side of the support, and a release sheet integrated thereto to cover the adhesive layer, wherein a tack sheet is employed wherein a cationic polymer is contained or impregnated in at least one of the support and the ink-receiving layer, and the ink jet recording sheet has an internal bond strength of from 120 to 320 g·cm/cm$^2$ as measured in a wet state after being immersed in water at 20° C. for 10 seconds, in accordance with TAPPI USEFUL METHODS NO. 403, and the amount of the ink to be recorded per unit area is controlled so that the weight ratio of V/I would be at least 110 wt %, where I is the amount of the ink to be recorded per unit area and V is the water absorption degree of the ink jet recording sheet as measured in accordance with JIS P8140.

Now, the present invention will be described in detail with reference to the preferred embodiments.

The present inventors have conducted an extensive research on the problem of an increase in the peel strength between the ink jet recording sheet (hereinafter referred to simply as the recording sheet) and the release sheet at the time of printing with water-color ink or upon accidental absorption of water or moisture condensation during the use of the tack sheet, and, as a result, have found that the ink or water penetrates and reaches the interface between the recording sheet and the adhesive layer to be caused such a problem. This problem is believed to cause in such a manner that by the presence of the water-color ink or water at the interface, the internal bond strength of the recording sheet deteriorates or the adhesive in the adhesive layer swells or hardens, whereby the adhesive strength between the release sheet and the adhesive layer increases.

As mentioned above, the increase in the peel strength between the recording sheet and the release sheet promotes ply separation of the support for the tack sheet for ink jet recording in a wet state and remarkably deteriorates the labeler applicability of the tack sheet. To obtain a tack sheet for ink jet recording having good labeler applicability, it is believed necessary to provide internal bond strength so that the support of the recording sheet will not undergo ply separation even if the peel strength increases due to wetting. Accordingly, a study has been made on the relation between the internal bond strength of the recording sheet in a wet state and the ply separation and labeler applicability. As a result, it has been found that when the ink jet recording sheet in a wet state upon immersion in water at 20° C. for 10 seconds, has an internal bond strength of from 120 to 320 g·cm/cm$^2$ as measured in accordance with TAPPI USEFUL METHODS NO. 403, no ply separation occurs at the support portion of the recording sheet, and good labeler applicability can be obtained. If the internal bond strength in the wet state is less than 120 g·cm/cm$^2$, ply separation tends to occur at the support portion, and if it exceeds 320 g·cm/cm$^2$, ply separation tends to occur between the recording sheet and the adhesive layer, and the adhesive layer tends to transfer to the release sheet side, whereby the labeler applicability will be poor.

Further, as mentioned above, due to an increase in the peel strength between the recording sheet and the release sheet, the release sheet may not be peeled from the recording sheet by a labeler, thus leading to a problem of peeling failure. On the other hand, due to a decrease in the peel strength, there will be a problem that the release sheet tends to be detached from the recording sheet. In order to obtain good labeler applicability without bringing about these problems, it was necessary to consider the peeling properties as between the recording sheet and the release sheet, particularly the water immersion peel strength of the tack sheet. Accordingly, the peel strength in a wet state and the peeling properties of the tack sheet have been studied, and as a result, it has been found that when the water immersion peel strength of the recording sheet against the release sheet is from 6 to 50/3 cm as measured after immersion in water in accordance with JIS Z0247/1980, the peeling properties between the recording sheet and the release are good. Here, if the water immersion peel strength is less than 6 g/3 cm, detachment of the label tends to be problematic, and if it exceeds 50 g/3 cm, the peel strength in a wet state tends to exceed the proper range for application of a labeler, thus leading to a practical problem.

Uses of the tack sheet for ink jet recording have been diversified, and it has been common to employ multicolor printing in order to obtain an image excellent in the image reproduction and the color reproduction such as sharpness and color effect. To improve the commercial value, still better image reproducibility and color reproducibility are demanded. Consequently, the amount of ink used for forming an image increases. Accordingly, a problem of ply separation or failure in the labeler applicability is likely to result due to an increase in the peel strength for the above mentioned reasons. To solve such a problem, it is necessary to completely absorb the ink used for forming the image before it reaches to the interface between the recording sheet and the adhesive layer.

Further, on the printed image surface, if ink absorption by the recording sheet is poor, problems such as smudging of the image due to brimming of ink, staining of the background and deterioration of the image reproducibility due to non-uniform ink absorption, are likely to result. Accordingly, it was essential to improve the ink absorption of the recording sheet.

Under the circumstances, the present inventors have conducted a study on the water absorptivity and the peeling properties of the recording sheet and the printed image reproducibility. As a result, it has been found that when the water absorption degree of the ink jet recording sheet in a contact time of 10 seconds as stipulated in JIS P8140, is at least 110 wt % of the weight of the ink recordable per unit area, the accidental absorption of water or the increase in the peel strength after printing the image can be suppressed, and it is possible to obtain good peeling properties and image reproducibility. Here, if the water absorption degree of the recording sheet is less than 110 wt %, smudging of the printed image or staining of the background as mentioned above, tends to result, and the problem such as deterioration of the labeler applicability due to an increase of the peel strength is likely to result.

In the measurement of the water absorption degree in the present invention, the contact time of the recording sheet with water is set to be 10 seconds. This contact time is so set, since when penetration of ink is taken into consideration, it is necessary that the majority of ink will complete the penetration within the 10 seconds and will enter the drying step, and if penetration will not complete within 10 seconds, ink brimming will result which indicates a delay in the ink absorption. Accordingly, with a contact time of 120 seconds commonly employed in the measurement method, ink absorption can not be taken into consideration, and thus the ink absorption which is important to the ink jet recording properties is neglected. However, by employing the water absorption degree with the contact time set to be 10 seconds, it is possible to secure the ink absorption and good image reproducibility and to obtain a tack sheet for ink jet recording whereby failure in the labeler applicability due to an increase in the peel strength of the recording sheet can be prevented.

The present invention has a feature that a cationic polymer is contained or impregnated in at least one of the support or the ink-receiving layer. The cationic polymer has dual functions as a fixing agent for water-color ink used for ink jet recording and as a wet strength agent. By incorporating or impregnating such a cationic polymer in the support or the ink-receiving layer, it will be possible to improve the water resistance of the recording sheet and the printed portion and to suppress deterioration of the internal bond strength or an increase in the peel strength of the recording sheet in a wet state. Among such cationic polymers, it is particular preferred to employ at least one member selected from the group consisting of a polycondensate of dicyandiamide and a polyvinyl amine. These two types of cationic polymers have high cationic charge densities, and by incorporating or impregnating such a polymer to the support or the ink-receiving layer, it is possible to impart good peeling properties as well as water resistance and internal bond strength in a wet state which are further improved over the ones attainable by the above mentioned other cationic polymers.

The increase in the peel strength is caused by e.g. deterioration of the internal bond strength of the recording sheet or swelling or hardening of the adhesive in the adhesive layer, which in turn is caused by the presence of water-color ink or water at the interface between the recording sheet and the adhesive layer. Accordingly, with respect to the recording sheet surface, an attempt has been made to maintain labeler applicability such as the above mentioned improvement of the internal bond strength for suppression of the peel strength. In order to lower the peel strength in a wet state to obtain a tack sheet for ink jet recording having further improved labeler applicability, the present inventors have conducted a study on adhesives and the increase in the peel strength. Adhesives are generally classified into a solvent-type and an aqueous type, and it has been found that when an aqueous adhesive of emulsion type obtained by emulsion polymerization in water employing a surface active agent, is used, the increase in the peel strength by rewetting is remarkable, and deterioration in the strength of the adhesive layer itself due to swelling may sometimes result, and peeling is likely to take place between the adhesive layer and the recording sheet. However, it has been found possible to solve this problem by using an organic solvent-type adhesive. This is believed to be attributable to the fact that no deterioration in the strength of the adhesive layer is brought about unlike the aqueous adhesive, although an increase in the peel strength due to swelling is observed by the organic solvent type adhesive upon rewetting due to penetration of the water-color ink or water.

In the tack sheet for ink jet recording according to the first aspect of the present invention (which corresponds to claim 1), the internal bond strength of the recording sheet in a wet state is adjusted to be from 120 to 320 g·cm/cm$^2$, whereby it is possible to provide a tack sheet for ink jet recording, which provides good labeler applicability without ply separation of the recording sheet or label peeling failure even when water is accidentally absorbed. Further, when the water immersion peel strength in a wet state is adjusted to a level of from 6 to 50 g/3 cm within the above mentioned range of the internal bond strength, it is possible to further reduce detachment of the label from the release sheet or the possibility for ply separation of the label or for the peeling failure.

When the water absorption degree of the recoding sheet is adjusted to be at least 110 wt % of the weight of the ink recordable per unit area within the above mentioned ranges, it is possible to present a tack sheet for ink jet recording, which is free from smudging of a printed image or staining of the background and which has excellent peeling properties and image reproducibility at the same time.

Further, when a polycondensate of dicyandiamide or a polyvinyl amine is used as the cationic polymer to be contained or impregnated in at least one of the support and the ink-receiving layer, within the above mentioned ranges, it is possible to obtain a printed image which is further improved over the image obtainable with other cationic polymers, or to impart water resistance, internal bond strength in a wet state and good peeling properties to the recording sheet.

Still further, when the adhesive layer of the recording sheet is made of a solvent-type adhesive, within the above mentioned ranges, the strength of the adhesive layer will not deteriorate, whereby no peeling will take place between the recording sheet and the adhesive layer, and it is possible to impart good labeler applicability to the recording sheet.

The tack sheet for ink jet recording according to the second aspect of the present invention (which corresponds to claim 6) is characterized in that the internal bond strength of the recording sheet in a wet state is from 145 to 30 g·cm/cm$^2$ and the water immersion peel strength is from 12 to 44 g/3 cm. By such a feature, it is possible to further reduce detachment of the label from the release sheet of the recording sheet in a wet state, or occurrence of ply separation or peeling failure of the recording sheet and thereby to present a tack sheet for ink jet recording having good properties. Further, when the water absorption degree of the recording sheet is adjusted to at least 110 wt % of the weight of the ink recordable per unit area, within the above mentioned ranges, it is possible to improve the peeling properties and image reproducibility by preventing smudging of the printed image or staining of the background of the recording sheet and thereby to impart further improved properties as a tack sheet.

When a polycondensate of dicyandiamide or polyvinyl amine is used as the cationic polymer to be contained or impregnated in at least one of the support and the ink-receiving layer, within the above mentioned ranges, it is possible to obtain a printed image which is better than that obtainable by other cationic polymers, and it is possible to impart water resistance, internal bond strength in a wet state and good peeling properties to the recording sheet.

When the adhesive layer of the recording sheet is made of a solvent-type adhesive, within the above mentioned ranges, strength of the adhesive layer will not deteriorate, and no peeling takes place between the recording sheet and the adhesive layer, whereby it is possible to impart good labeler applicability to the recording sheet.

The tack sheet for ink jet recording according to the third aspect of the present invention (which corresponds to claim 10) is characterized in that in order to make the object of the present invention clear, the internal bond strength of the recording sheet in a wet state is from 170 to 280 g·cm/cm$^2$, the water immersion peel strength is from 18 to 38 g/3 cm, and the water absorption degree of the recording sheet is at least 110 wt % of the weight of the ink recordable per unit area. By such a feature, it is possible to present a tack sheet for ink jet recording having both excellent properties as a tack sheet, such as detachability or peeling properties of the label from the release sheet of the recording sheet in a wet state and excellent properties as an ink jet recording sheet such as water resistance of the recording sheet, freeness from smudging of the printed image or staining of the background and image reproducibility. Further, when a polycondensate of dicyandiamide or a polyvinyl amine is used as the cationic polymer to be contained or impregnated in at least one of the support and the ink-receiving layer, in the above mentioned ranges, it is possible to obtain a printed image which is further improved over that obtainable by other cationic polymers and to impart water resistance, internal bond strength in a wet state and excellent peeling properties to the recording sheet. Furthermore, when the adhesive layer of the recording sheet is made of a solvent-type adhesive, strength of the adhesive layer will not deteriorate, and no peeling will take place between the recording sheet and the adhesive layer, whereby it is possible to present a tack sheet having good labeler applicability.

The tack sheet for ink jet recording according to the fourth aspect of the present invention (which corresponds to claim 13) is characterized in that the internal bond strength of the recording sheet in a wet state is from 170 to 280 g·cm/cm$^2$, and the water absorption degree of the recording sheet is at least 110 wt % of the weight of the ink recordable per unit area. By such a feature, it will possible to avoid ply separation at the support portion of the recording sheet or label peeling failure when water is accidentally absorbed, and it will be possible to obtain good image reproducibility without smudging of a printed image or staining of the background. It is thus possible to present a tack sheet for ink jet recording, which has particularly good properties as an ink jet recording sheet.

When the water immersion peel strength in a wet state is adjusted to be from 6 to 50 g/3 cm, within the above ranges, it is possible to reduce detachment of the label from the release sheet or occurrence of ply separation of the label or peeling failure, and it is possible to obtain further improved properties as a tack sheet.

Further, when a polycondensate of dicyandiamide or a polyvinyl amine is used as the cationic polymer to be contained or impregnated in at least one of the support and the ink-receiving layer, within the above mentioned ranges, it is possible to obtain a printed image which is further improved over that obtainable by other cationic polymers and to impart water resistance, internal bond strength in a wet state and good peeling properties to the recording sheet. Thus, it is possible to further improve the properties as a tack sheet for ink jet recording.

Furthermore, when the adhesive layer of the recording sheet is made of a solvent-type adhesive, within the above mentioned ranges, strength of the adhesive layer will not deteriorate, and no peeling will take place between the recording sheet and the adhesive layer, whereby it will be possible to impart good labeler applicability to the recording sheet.

For the preparation of the adhesive layer of the present invention, it is usual to employ a method wherein an adhesive is applied on a release agent-coated side of a release sheet which will be described hereinafter, and the adhesive side and the side of an ink-receiving sheet on which no ink-receiving layer is coated, are put together, followed by press bonding by e.g. a press roll. However, the adhesive may firstly be coated on the ink-receiving sheet, and then a release sheet may be put thereon. As the adhesive, a rubber-type adhesive or an acrylic resin type adhesive may be employed. The main material of the rubber-type adhesive is natural rubber or styrene-butadiene rubber. To the natural ruber, a rhodine-type resin or a plasticizer may be incorporated, and usually, n-hexane is used as a solvent for coating. The acrylic resin type adhesive may be prepared by polymerizing an acrylic monomer such as 2-ethylhexyl acrylate, butyl acrylate, ethyl acrylate, acrylic acid or β-hydroxyethyl acrylate, in an organic solvent.

Further, in order to improve the physical properties such as the heat resistance and the solvent resistance of the adhesive, a crosslinking agent of isocyanate type, melamine type or metal chelate type may be reacted to the above material for crosslinking reaction, or a pigment such as silica, kaolin, clay, calcium carbonate, aluminum hydroxide, zinc oxide, titanium oxide, melamine resin particles or starch particles, may be incorporated to the above material. Further, a water-soluble polymer, a petroleum-type resin, various paraffin waxes, a fatty acid or its derivative, a higher alcohol, a metal soap, a silicone as well as an antistatic agent, a thickener, a dispersant, a preservative, an antioxidant or a defoaming agent, may be incorporated. Such an adhesive may selected for use depending upon the particular purpose for which the ink jet recording sheet for labeling is employed.

The apparatus for applying the adhesive may, for example, be an air knife coater, a blade coater, a bar coater, a roll coater or a curtain coater as well as a lip coater, a slot nozzle, a slot die, a rotary screen printer, a gravure coater, an offset gravure coater, a hot melt wheel or a spiral spray. It may suitably be selected depending upon the type and the coating amount of the adhesive, or the particular purpose such as the necessity to impart a pattern to the coated adhesive.

As the base material for the release sheet, wood free paper, kraft paper, glassine paper, impregnated paper or a plastic film may, for example, be mentioned. On such a base material, a silicone resin is coated as a release agent. In the case of a paper type base material, a thermoplastic resin may preferably be laminated on the base material to form a smooth surface so as to improve the peeling properties. The one having a silicone resin directly coated on a paper type base material is called a direct type. The one having a thermoplastic resin laminated on a paper base material, followed by the silicone resin coating, is called a polylami type. The one having the silicone resin directly coated on a plastic film is called a film type. Among them, a release sheet is selected on such a basis that the release sheet has an adhesive force not to be peeled during transportation in an ink jet recording apparatus, and it has an adhesive force not higher than the peeling force of an automatic labeler when the automatic labeler is used for labeling. Accordingly, the release sheet is selected depending upon the particular purpose. Further, when it is necessary to secure a curling property, it is preferred to laminate a thermoplastic resin or coat a synthetic resin, as a rear side treatment, to the opposite side of the base material on which the silicone resin is coated. Further, for a special application, a release agent of non-silicone type may be employed.

The support to be used in the present invention may be base paper produced by various apparatus such as a Fourdrinier paper machine, a cylinder paper machine or a twin wire paper machine from a mixture prepared by mixing at least one of various conventional additives including a pigment, a binder, a sizing agent, a fixing agent, a yield-improving agent, a cationic agent and a paper strength-increasing agent to a main component of a wood pulp including, for example, a chemical pulp such as LBKP or NBKP, a mechanical pulp such as GP, PGW, RMP, TMP, CTMP, CMP or CGP, and a waste paper pulp such as DIP. Further, it may be a coated paper having a coating layer provided on such base paper, such as art paper, coated paper or cast coated paper. On such base paper or coated paper, an ink-receiving layer may be directly formed. Otherwise, in order to control the flatness, a calendering apparatus such as a machine calender, or a TG calender or a soft calender, may be employed.

Further, the support may have a pigment incorporated in an amount of at least 5 wt %, preferably from 5 to 45 wt %, per 100 wt % of the pulp, so that void spaces formed by the wood pulp and the pigment will absorb ink, and it will be unnecessary to coat a large amount of an ink-receiving layer. Further, to the support, other additives such as a pigment-dispersing agent, a thickener, a fluidity-improving agent, a defoaming agent, a foam-suppressing agent, a release agent, a blowing agent, a penetrating agent, and ash-preventive agent, a water-proofing agent, a wet strength agent, a dry strength agent, and a color-adjusting dye may be incorporated as the case requires.

The ink-receiving layer in the present invention is preferably composed of a coating composition comprising a pigment, an adhesive and a cationic compound as the main components, and to such main components, a dye-fixing agent, a pigment dispersant, a thickener, a fluidity-improving agent, a defoaming agent, a foam-suppressing agent, a release agent, a blowing agent, a penetrating agent, a coloring dye, a coloring pigment, a fluorescent brightener, an ultraviolet absorber, an antioxidant, a preservative, an ash-preventive agent, a water proofing agent, a wet strength agent or dry strength agent may suitably be added as additives.

In the present invention, the cationic polymer contained or impregnated in at least one of the support and the ink-receiving layer is the one which dissociates to cations in an aqueous medium. As typical cationic groups, primary, secondary and tertiary amino groups and quaternary ammonium salts may be mentioned. The cationic polymer may, for example, be a polyalkylene polyamide, a polyalkylene polyurea, a polyamide polyurea, a polyamide epoxy resin or a reaction product of such a polymer with an aldehyde or with an alkylating agent, or a ring-opened polymer of ethyleneimine, a homopolymer of a cationic vinyl polymer or a copolymer thereof with another polymerizable polymer, a homopolymer of an N-vinyl amide monomer or a copolymer thereof with another polymerizable polymer, a Mannich reaction product having ammonia, a primary amine or a secondary amine and formaldehyde reacted to a polymer having an active hydrogen, a reaction product of a cationic agent with a polymer having an active hydrogen, a reaction product of ammonia, an amine or epihalohydrin with a polymer having an active hydrogen, or a copolymer obtained by reacting any one of the above mentioned polymers with a polymer having a chitosan active hydrogen obtained by hydrolyzing chitin, by means of a crosslinking agent such as an aldehyde, epihalohydrin or a polyisocyanate.

Uses of a tack sheet having an adhesive layer provided on the opposite side of a support on which an ink-receiving layer is formed, are diversified, and the required levels for water resistant strength of the recording sheet and for prevention of smudging of ink due to deposition of water or sweat are increasingly high. Accordingly, among the above mentioned cationic polymers, it is particularly preferred to employ at least one member selected from the group consisting of a polycondensate of dicyandiamide and a polyvinyl amine. These two types of cationic polymers have high cationic charge densities, and by incorporating or impregnating such polymers to the support or the ink-receiving layer, it will be possible to impart water resistance which is further improved over the water resistance attainable by the above mentioned other cationic polymers.

In the present invention, as the pigment to be used for the support and the ink-receiving layer, at least one member selected from conventional white pigments and starch particles can be employed. For example, as the pigment, a white inorganic pigment such as light calcium carbonate, heavy calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic non-crystalline silica, colloidal silica, colloidal alumina, pseudo boehmite, aluminum hydroxide, alumina, lithopone, zeolite, hydrolized halloysite, magnesium carbonate or magnesium hydroxide, or an organic pigment such as a styrene-type plastic pigment, an acrylic plastic pigment, polyethylene, microcapsules, a urea resin or a melamine resin, may, for example, be used. Among the above pigments, a porous inorganic pigment is preferred, and porous non-crystalline synthetic silica, porous magnesium carbonate, or porous alumina may, for example, be mentioned. Particularly preferred is porous synthetic non-crystalline silica having a large pore volume.

Further, the starch particles may, for example, be those prepared from such raw materials as corn starch, wheat, barley, rice, potatoes (white potatoes), cassava (tapioca), sweet potatoes or sago, or the following (A) to (I) prepared by processing such raw materials, and rice starch powder is particularly preferred.

(A) Oxidized starch obtained by oxidation with an oxidizing agent such as sodium hypochlorite.

(B) Acid-treated starch treated with e.g. hydrochloric acid or sulfuric acid.

(C) Enzyme-treated starch.

(D) Dialdehyde starch reacted with periodic acid.

(E) Esterified starch such as acetylated starch, urea phosphorylated starch or phosphorylated starch.

(F) Etherified starch such as hydroxyalkylated starch or carboxyalkylated starch.

(G) Cationic starch (H) Crosslinked starch such as formaldehyde-crosslinked starch or epichlorohydrin-crosslinked starch or phosphoric acid-crosslinked starch.

(I) Graft polymerized starch obtained by polymerization to a starch having active sites prepared by a vinyl monomer such as acrylic acid, acrylonitrile, acryl amide, a methacrylic acid ester or vinyl acetate, or by a cyclic monomer such as an epoxide, an episulfide or an imine or a lactam.

Among these starch particles, the one having no or little cold water solubility is preferred in order to maintain the particle shape in the ink jet recording sheet of the present invention. Particularly preferred is the one which has no substantial solubility in water at a temperature of not higher than 40° C. and which has a gelatinization initiation temperature of at least 50° C. Further, the size of the starch particles is preferably such that the volume average particle size is within a range of from 1 to 10 μm, in order to secure the absorption rate and absorption amount of ink and the quality of the recorded image properly.

Further, it is possible to provide two or more ink-receiving layers on the support, and the printing surface may appropriately be selected to meet a requirement for e.g. a matte type, a coated type, an art type, a cast type or a film type.

The water base polymer binder to be used for the ink-receiving layer or the support of the present invention may, for example, be a starch derivative such as oxidized starch, etherified starch or phosphate starch; a cellulose derivative such as carboxymethyl cellulose, hydroxyethyl cellulose; a casein, gelatin, soybean protein, polyvinyl alcohol or a polyvinyl alcohol derivative such as a silyl-modified polyvinyl alcohol; a polyvinyl pyrrolidone, a maleic anhydride resin, a styrene-butadiene copolymer or a conjugated diene type copolymer latex such as a methyl methacrylate-butadiene copolymer; an acrylic (co)polymer latex such as a polymer or copolymer of an acrylic acid ester or a methacrylic acid ester; a vinyl-type copolymer latex such as an ethylene-vinyl acetate copolymer; or a functional group-modified (co)polymer latex of such a various (co)polymer with a monomer containing a functional group such as accarboxyl group; an aqueous adhesive such as a thermosetting synthetic resin such as a melamine resin or a urea resin; an acrylic acid ester such as a polymethyl methacrylate, or a polymer or copolymer resin latex of a methacrylic acid ester; a polyurethane resin, an unsaturated polyester resin, a vinyl chloride-vinyl acetate copolymer, a polyvinyl butyral, or an alkyl resin latex. Such binders may be used alone or in combination as a mixture of two or more of them. Among such water base polymer binders, polyvinyl alcohol or polyvinyl alcohol derivative such as a silyl-modified polyvinyl alcohol is preferred from the viewpoint of the adhesive strength.

The cationic polymer to be contained or impregnated in the support, may be coated or impregnated as the polymer alone. Otherwise, it may be incorporated as a paper strength-improving agent at the time of preparation of the support. It is also possible to impregnate or coat a composition having the above mentioned pigment and the adhesive combined with the cationic polymer. However, it is preferred to incorporate or impregnate the cationic polymer, since the effects of the present invention can further be ensured by distributing the cationic polymer in the depth direction of the support.

The amount of the cationic polymer impregnated or contained in the support is preferably determined on the basis of the cationic charge per unit area of the support. Here, the cationic charge is the product (meq/$m^2$) of the cationic charge (meq/g) per unit weight of the polymer as measured by colloidal titration and the amount (g/$m^2$) of the polymer deposited per unit area.

In the tack sheet for ink jet recording of the present invention, the cationic polymer is preferably impregnated or contained in the support so that the cationic charge per unit area will be at least 0.2 meq/$m^2$, preferably at least 0.5 meq/$m^2$. If the charge is less than 0.2 meq/$m^2$, not only it tends to be difficult to obtain the internal bond strength or peel strength in wet state which satisfies the object of the present invention, but also it tends to be difficult to avoid smudging of ink due to water.

As an apparatus for coating or impregnating the cationic polymer or a composition containing such a polymer, to the support, various apparatus such as a blade coater, a roll coater, an air knife coater, a bar coater, a rod blade coater, a curtain coater, a short dwell coater, a size press or a spray, can be used on machine or off machine. The object of the present invention can further be ensured by an on machine apparatus whereby preparation of the support is followed continuously by coating or impregnation.

The ink-receiving layer to be formed on the support is preferably formed by a composition comprising the above mentioned pigment, the adhesive and the cationic polymer as the main components, whereby the void spaces are secured to facilitate absorption and fixing of ink, such being desirable. The coating amount of the ink-receiving layer is preferably determined based on the cationic charge per unit area of the ink-receiving layer. It is preferably formed on the support so that the cationic charge per unit area will be at least 0.5 meq/$m^2$, preferably at least 0.8 meq/$m^2$. If the charge is less than 0.5 meq/$m^2$, not only it tends to be difficult to obtain the internal bond strength or peel strength in a wet state which satisfies the object, but also it tends to be difficult to avoid smudging of ink due to water.

As an apparatus for coating the ink-receiving layer, various apparatus, such as a blade coater, a roll coater, an air knife coater, a bar coater, a rod blade coater, a curtain coater, a short dwell coater, a size press or a spray, can be used on machine or off machine. Further, after coating the ink-receiving layer, finishing may be applied by means of a calender such as a TG calender, a super calender or a soft calender.

The water-color ink in the present invention is a recording liquid comprising a coloring agent, a liquid medium and other additives.

As the coloring agent, a water-soluble dye such as a direct dye, an acid dye, a basic dye, a reactive dye or a dye for food, may be mentioned.

The method for jetting the water-soluble ink is not limited to a piezo system or a valve system.

The medium for the water-color ink includes water and various water-soluble organic solvents, for example, a $C_{1-4}$ alkyl alcohol such as methyl alcohol, ethyl alcohol, n-propyl alcohol, isopropyl alcohol, n-butyl alcohol sec-butyl alcohol, tert-butyl alcohol or isobutyl alcohol; an amide such as dimethyl formamide or dimethyl acetamide; a ketone alcohol such as acetone or diacetone alcohol; an ether such as tetrahydrofuran or dioxane; a polyalkylene glycol such as polyethylene glycol or polypropylene glycol; an alkylene glycol having from 2 to 6 alkylene groups such as ethylene glycol, propylene glycol, butylene glycol, triethylene glycol, 1,2,6-hexanetriol, thiodiglycol, hexylene glycol or diethylene glycol; a lower alcohol ether of polyhydroxy alcohol such as glycerol, ethylene glycol methyl ether, diethylene glycol, methyl (or ethyl) ether or triethylene glycol monomethyl ether. Among such many water-soluble organic solvents, a polyhydric alcohol such as diethylene glycol, or a lower alkyl ether of a polyhydric alcohol such as triethylene glycol monomethyl ether or triethylene glycol monomethyl ether, is preferred. As other additives, a pH controlling agent, a metal sealing agent, a mildewproofing agent, a viscosity controlling agent, a surface tension controlling agent, a wetting agent, a surfactant and a rust preventing agent may, for example, be mentioned.

The tack sheet for ink jet recording according to the present invention may be used as any recording sheet of the type whereby a liquid ink is used for its recording. For example, it may be an image-receiving sheet for heat transfer recording of the type, whereby an ink sheet having a heat meltable ink containing e.g. a heat meltable substance, a dye or pigment, etc. as the main components, coated on a thin support such as a resin film, a high density paper or a synthetic paper, is heated from its rear side to melt and transfer the ink to the image-receiving sheet, an ink jet recording sheet of the type whereby a heat meltable ink is heated, melted and jetted in the form of fine droplets for recording, or an image-receiving sheet corresponding to a photo- and pressure-sensitive donor sheet employing microcapsules containing a photo polymerizable monomer and a colorless or colored dye or pigment.

A common feature of these recording sheets is that the ink is in a liquid state at the time of recording. A liquid ink will penetrate or diffuse in the depth direction or horizontal direction of the ink-receiving layer of the recording sheet before hardening, immobilizing or fixing. The above mentioned various recording sheets require absorption suitable for the respective systems, and the tack sheet for ink jet recording of the present invention may be used as a tack sheet for the above mentioned various recording systems.

The tack sheet for ink jet recording according to the present invention exhibits good peeling performance and water resistance of the recorded image even in a wet state. In order to improve wet strength of a support, it is common to apply treatment so that water will not penetrate into the support, but the ink absorption will also decrease with the decrease in the water absorption of the support, whereby brimming of ink or staining of the background will result at the time of printing an image. Further, when the tack sheet after printing, is exposed to a wet condition, water will not penetrate into the support and will remain on the support until it is evaporated. Consequently, the water-color ink tends to be redissolved, and smudging of ink wiresult.

Accordingly, it is necessary to improve the wet strength without lowering the water absorption of the support and to selectively fix the water-color ink. The ink is composed mainly of a dye component and a solvent component. To prevent re-dissolution of ink by water, it is necessary to form a salt insoluble in water by a reaction of the sulfonate or carboxylate of the dye component. For this purpose, the reaction with a compound is conceivable, but with a low molecular weight cationic compound such as a monomer or an oligomer, the water resistance of the compound itself is low, and no satisfactory water resistance can be obtained.

As shown by the present invention, it is possible to obtain a tack sheet for ink jet recording which satisfies the object only by incorporating or impregnating a cationic polymer in at least one of the support or the ink-receiving layer. Namely, the cationic polymer provides an effect as a wet strength agent for the support and thus improves the internal bond strength of the support in a wet state without lowering the ink absorption, whereby a proper level of water immersion peel strength can be maintained. Further, due to the above mentioned insolubilization reaction of the cationic polymer with the ink, the water resistance of the printed image will be improved, and the water resistance of the polymer itself is high, whereby the water resistance of the recording sheet can also be improved.

Further, the internal bond strength of the recording sheet in a wet state when the cationic polymer is used, is adjusted to be from 120 to 320 g·cm/cm$^2$, and the water immersion peel strength is adjusted to be from 6 to 50 g/3 cm, whereby the ranges are defined so that good peeling properties and labeler applicability can be maintained even when the peel strength increases due to water. Further, by adjusting the water absorption degree of the recording sheet to a level of at least 110 wt % of the weight of the ink recordable per unit area, it is possible to maintain the desired properties as a recording sheet such as avoidance of smudging of a printed image or staining of the background of the recording sheet as well as the desired properties as a tack sheet such as improvement in the peeling properties due to suppression of the increase in the peel strength of the adhesive layer due to water. By such features, the object of the present invention can be ensured.

Further, when a polycondensate of dicyandiamide or a polyvinyl amine is used as the cationic polymer to be applied to the recording sheet, it is possible to impart an excellent ink fixing ability and wet paper strength without lowering the ink absorption, whereby it is possible to further improve the desired properties as a tack sheet for ink jet recording.

Furthermore, when a solvent-type adhesive is used as the adhesive, it is possible to avoid deterioration of the strength of the adhesive layer even upon accidental absorption of water and to suppress peeling between the recording sheet and the adhesive layer, whereby the object of the present invention can further be ensured.

Now, the present invention will be described in further detail with reference to Examples. However, it should be understood that the present invention is by no means restricted to such specific Examples. In the Examples, "parts" and "%" mean "parts by weight" and "% by weight" unless otherwise specified.

EXAMPLES 1 TO 39 AND COMPARATIVE EXAMPLES 1 TO 10

These Examples and Comparative Examples were carried out as identified in Tables 1 to 4 using the following supports A to C, support treating methods 1 to 11, ink-receiving layers A to G, and adhesive layers A and B.

Preparation of supports

Supports A to C used in the present invention, were prepared as follows.

Support A

Added to 100 parts of wood pulp comprising 70 parts of LBKP having a freeness of 450 ml CSF and 30 parts of NBK having a freeness of 450 ml CSF were 25 parts of a pigment composed of light calcium carbonate/heavy calcium carbonate/talc in a weight ratio of 30/35/35, 1.0 part of commercially available cationic starch, 0.1 part of commercially available alkyl ketene dimer, 0.03 part of commercially available cationic acrylamide and 0.5 part of aluminum sulfate, and the pH of the pulp slurry was adjusted to 8.2. Then, the pulp slurry was formed into paper of 90 g/m$^2$ by means of a Fourdrinier paper machine to obtain a support.

Support B

Added to 100 parts of wood pulp comprising 70 parts of LBKP having a freeness of 450 ml CSF and 30 parts of NBKP having a freeness of 450 ml CSF were 15 parts of a pigment composed of light calcium carbonate/heavy calcium carbonate/talc in a weight ratio of 30/35/35, 1.0 part of commercially available cationic starch, 0.1 part of commercially available alkyl ketene dimer, 0.03 part of commercially available cationic acrylamide and 0.5 part of aluminum sulfate, and the pH of the pulp slurry was adjusted to 8.2. Then, the pulp slurry was formed into paper of 90 g/m$^2$ by means of a Fourdrinier paper machine to obtain a support.

Support C

Added to 100 parts of wood pulp comprising 70 parts of LBKP having a freeness of 450 ml CSF and 30 parts of NBKP having a freeness of 450 ml CSF were 5 parts of a pigment composed of light calcium carbonate/heavy calcium carbonate/talc in a weight ratio of 30/35/35, 1.0 part of commercially available cationic talc, 0.1 part of commercially available alkyl ketene dimer, 0.03 part of commercially available cationic acrylamide and 0.5 part of aluminum sulfate, and the pH of the pulp slurry was adjusted to 8.2. Then, the pulp slurry was formed into paper of 90 g/m$^2$ by means of a Fourdrinier paper machine to obtain a support.

Methods for treating supports

In the present invention, support treating methods such as incorporation or impregnation methods to the supports and the types and incorporated amounts of compounds, are the following methods 1 to 11. Compounds were used at a solid content concentration of 5% in all cases, and coating by a size press or a gate roll coater was carried out on machine in all cases. Further, the coated amounts indicated here are all dried coated amounts.

1. A polyamide-epichlorihydrin resin (WS525; manufactured by Nippon PMC K.K.) was incorporated in an amount of 1% to the pulp.

2. A polyvinyl amine copolymer (High max SC-700; manufactured by Haimo K.K.) was incorporated in an amount of 1% to the pulp.

3. A dimethylamine-epichlorohydrin polycondensate (Polyfix P-601, manufactured by Showa Kobunshi K.K.) was incorporated in an amount of 1% to the pulp.

4. An acrylamide-diallylamine polymer (Sumireze resin 1001; manufactured by Sumitomo Chemical Co., Ltd.) was size-pressed on the surface of the support in an amount of 0.5 g/m$^2$.

5. A dicyandiamide-formalin polycondensate (High max SC-5H; manufactured by Haimo K.K.) was size-pressed on the surface of the support in an amount of 0.5 g/m$^2$.

6. A dicyandiamide-formalin polycondensate (High max SC-5H; manufactured by Haimo K.K.) was size-pressed on the surface of the support in an amount of 1.5 g/m$^2$.

7. A dicyandiamide-formalin polycondensate (High max SC-5H; manufactured by Haimo K.K.) was size-pressed on the surface of the support in an amount of 2.5 g/m$^2$.

8. A polyvinyl amine copolymer (High max SC-700; manufactured by Haimo K.K.) was size-pressed on the surface of the support in an amount of 1.5 g/m$^2$.

9. A dicyandiamide-formalin polycondensate (High max SC-5H; manufactured by Haimo K.K.) was coated on the surface of the support in an amount of 1.5 g/m$^2$ by a gate roll coater.

10. A dimethylamine-epichlorohydrine polycondensate (Polyfix P-601; manufactured by Showa Kobunshi K.K.) was size-pressed on the surface of the support in an amount of 1.5 g/m$^2$.

11. An oxidized starch (MS3800; manufactured by Nippon Shokuhin Kagaku K.K.) was size-pressed on the surface of the support in an amount of 1.5 g/m$^2$.

Coating compositions for ink-receiving layers

Ink-receiving layers A to G used in the present invention, were composed of the following coating compositions, and these compositions were coated on the supports by means of an air knife, then dried and subjected to calender treatment to obtain recording sheets.

Ink-receiving layer A 20 parts of colloidal silica (Snowtex-O; manufactured by Nissan Chemical Industries, Ltd.), 75 parts of synthetic non-crystalline silica (Fine seal X37B; manufactured by Tokuyama Soda Co., Ltd.), 25 parts of rice starch powder (Micropearl; manufactured by Shimada Kagaku K.K., average particle size: 4.9 μm), and 40 parts of polyvinyl alcohol (PVA117; manufactured by Kuraray Co., Ltd.) were blended to dispersing water, and the coating solution was adjusted to a concentration of 18% and coated so that the dry coated amount would be 8 g/m$^2$, to obtain ink-receiving layer A.

Ink-receiving layer B 20 parts of colloidal silica (Snowtex-O; manufactured by Nissan Chemical Industries, Ltd.), 75 parts of synthetic non-crystalline silica (Fine seal X37B; manufactured by Tokuyama Soda Co., Ltd.), 25 parts of rice starch powder (Micropearl; manufactured by Shimada Kagaku K.K., average particle size: 4.9 μm), and 40 parts of polyvinyl alcohol (PVA117; manufactured by Kuraray Co., Ltd.) and 30 parts of a cationic dye fixing agent (Sumireze resin 1001; manufactured by Sumitomo Chemical Co., Ltd.) were blended to dispersing water, and the coating solution was adjusted to a concentration of 18% and coated so that the dry coated amount would be 8 g/m$^2$, to obtain ink-receiving layer B.

Ink-receiving layer C 20 parts of colloidal silica (Snowtex-O; manufactured by Nissan Chemical Industries, Ltd.), 75 parts of synthetic non-crystalline silica (Fine seal X37B; manufactured by Tokuyama Soda Co., Ltd.), 25 parts of rice starch powder (Micropearl; manufactured by Shimada Kagaku K.K., average particle size: 4.9 μm), and 40 parts of polyvinyl alcohol (PVA117; manufactured by Kuraray Co., Ltd.) and 10 parts of a dicyandiamide-formalin polycondensate (High max SC-5H; manufactured by Haimo K.K.) were blended to dispersing water, and the coating solution was adjusted to a concentration of 18% and coated so that the dried coated amount would be 8 g/m$^2$, to obtain ink-receiving layer C.

Ink-receiving layer D 20 parts of colloidal silica (Snowtex-O; manufactured by Nissan Chemical Industries, Ltd.), 75 parts of synthetic non-crystalline silica (Fine seal X37B; manufactured by Tokuyama Soda Co., Ltd.), 25 parts of rice starch powder (Micropearl; manufactured by Shimada Kagaku K.K., average particle size: 4.9 μm), and 40 parts of polyvinyl alcohol (PVA117; manufactured by Kuraray Co., Ltd.) and 20 parts of a dicyandiamide-formalin polycondensate (High max SC-5H; manufactured by Haimo K.K.) were blended to dispersing water, and the coating solution was adjusted to a concentration of 18% and coated so that the dried coated amount would be 8 g/m$^2$, to obtain ink-receiving layer D.

Ink-receiving layer E 20 parts of colloidal silica (Snowtex-O; manufactured by Nissan Chemical Industries, Ltd.), 75 parts of synthetic non-crystalline silica (Fine seal X37B; manufactured by Tokuyama Soda Co., Ltd.), 25 parts of rice starch powder (Micropearl; manufactured by Shimada Kagaku K.K., average particle size: 4.9 μm), and 40 parts of polyvinyl alcohol (PVA117; manufactured by Kuraray Co., Ltd.) and 30 parts of a polyvinyl amine type dye fixing agent (High max SC-700; manufactured by Haimo K.K.) were blended to dispersing water, and the coating solution was adjusted to a concentration of 18% and coated so that the dried coated amount would be 8 g/m$^2$, to obtain ink-receiving layer E.

Ink-receiving layer F 20 parts of colloidal silica (Snowtex-O; manufactured by Nissan Chemical Industries, Ltd.), 75 parts of synthetic non-crystalline silica (Fine seal X37B; manufactured by Tokuyama Soda Co., Ltd.), 25 parts of rice starch powder (Micropearl; manufactured by Shimada Kagaku K.K., average particle size: 4.9 μm), and 40 parts of polyvinyl alcohol (PVA117; manufactured by Kuraray Co., Ltd.) and 20 parts of cationic dye fixing agent (Polyfix P-601; manufactured by Showa Kobunshi K.K.) were blended to dispersing water, and the coating solution was adjusted to a concentration of 18% and coated so that the dried coated amount would be 8 g/m$^2$, to obtain ink-receiving layer F.

Ink-receiving layer G 20 parts of colloidal silica (Snowtex-O; manufactured by Nissan Chemical Industries, Ltd.), 75 parts of synthetic non-crystalline silica (Fine seal X37B; manufactured by Tokuyama Soda Co., Ltd.), 25 parts of rice starch powder (Micropearl; manufactured by Shimada Kagaku K.K., average particle size: 4.9 $\mu$m), 40 parts of polyvinyl alcohol (PVA117; manufactured by Kuraray Co., Ltd.) and 30 parts of cationic dye fixing agent (Cation G-50; manufactured by Sanyo Kasei Kogyo K.K.) were blended to dispersing water, and the coating solution was adjusted to a concentration of 18% and coated so that the dried coated amount would be 8 g/m$^2$, to obtain ink-receiving layer G.

Method for tack treatment

Adhesive layer A or B was formed by the following method on the other side of a recording sheet prepared by coating an ink-receiving layer on one side of a support, followed by calender treatment.

Adhesive layer A: coating of an adhesive layer composed of an aqueous adhesive

On glassine paper, a commercially available silicone resin was coated by a gravure coater so that the dry weight would be 1.5 g/m$^2$, and dried. Then, on the silicone resin-coated side, a commercially available aqueous acrylic emulsion adhesive was coated so that the dried coated amount would be 27 g/m$^2$. The adhesive-coated side and the recording sheet were bonded by a press roll to obtain adhesive layer A.

Adhesive layer B: coating of an adhesive layer composed of a solvent-type adhesive layer On glassine paper, a commercially available silicone resin was coated by a gravure coater so that the dry weight would be 1.5 g/m$^2$, and dried. Then, on the silicone resin-coated side, a commercially available solvent (ethyl acetate-toluene) type acrylic resin type adhesive was coated so that the dry coated amount would be 20 g/m$^2$. The adhesive-coated side and the recording sheet were bonded by a press roll to obtain adhesive layer B.

With respect to tack sheets for ink jet recording thus prepared, evaluation was made in accordance with the following evaluation methods, and the results are shown in Tables 1 to 4.

TABLE 1

| Examples or Comparative Examples | Support Type | Support Treating method | Type of ink-receiving layer | Type of adhesive layer | Wet internal bond strength g · cm/cm$^2$ | Upon immersion in water Peel strength | Upon immersion in water Peeling properties | Water absorption degree (%) | Labeler applicability | Water resistance of image | Brimming of ink |
|---|---|---|---|---|---|---|---|---|---|---|---|
| Example 1 | A | — | B | A | 126 | 45.0 | Δ | 334 | Δ | X | A |
| Example 2 | A | — | B | B | 126 | 33.7 | ○ | 334 | ○ | X | A |
| Example 3 | A | — | C | A | 135 | 38.0 | ○ | 381 | ○ | ○ | A |
| Example 4 | A | — | C | B | 135 | 28.7 | ○ | 381 | ○ | ○ | A |
| Example 5 | A | 4 | A | B | 123 | 41.2 | ○ | 352 | Δ | X | A |
| Example 6 | A | 5 | A | B | 136 | 39.4 | ○ | 341 | Δ | Δ | A |
| Example 7 | A | 1 | A | A | 145 | 47.5 | Δ | 342 | Δ | X | A |
| Example 8 | A | 4 | B | B | 141 | 31.2 | ○ | 307 | ○ | Δ | A |
| Example 9 | C | 2 | E | B | 310 | 9.2 | ○ | 278 | ○ | | A |
| Example 10 | C | 8 | E | B | 318 | 5.9 | ○ | 115 | ○ | ○ | B |

TABLE 2

| Examples or Comparative Examples | Support Type | Support Treating method | Type of ink-receiving layer | Type of adhesive layer | Wet internal bond strength g · cm/cm$^2$ | Upon immersion in water Peel strength | Upon immersion in water Peeling properties | Water absorption degree (%) | Labeler applicability | Water resistance of image | Brimming of ink |
|---|---|---|---|---|---|---|---|---|---|---|---|
| Example 11 | A | — | D | A | 149 | 35.6 | ○ | 356 | ○ | ○ | A |
| Example 12 | A | — | D | B | 149 | 25.5 | ○ | 356 | ○ | ○ | A |
| Example 13 | A | 6 | A | B | 151 | 35.8 | ○ | 321 | ○ | Δ | A |
| Example 14 | A | 9 | A | B | 154 | 35.2 | ○ | 323 | ○ | Δ | A |
| Example 15 | A | 1 | A | B | 146 | 39.1 | ○ | 342 | ○ | X | A |
| Example 16 | A | 2 | A | A | 153 | 44.1 | Δ | 338 | Δ | Δ | A |
| Example 17 | A | 2 | A | B | 153 | 34.5 | ○ | 338 | ○ | Δ | A |
| Example 18 | A | 5 | C | B | 151 | 26.4 | ⊙ | 292 | ○ | ○ | A |
| Example 19 | A | 1 | B | B | 163 | 30.2 | ○ | 271 | ○ | Δ | A |
| Example 20 | A | 2 | C | B | 168 | 26.0 | ⊙ | 283 | ○ | ○ | A |
| Example 21 | B | — | B | A | 172 | 39.6 | ○ | 273 | ○ | X | A |
| Example 22 | B | 4 | A | A | 170 | 46.3 | Δ | 308 | Δ | X | A |

TABLE 3

| Examples or Comparative Examples | Support Type | Support Treating method | Type of ink-receiving layer | Type of adhesive layer | Wet internal bond strength g · cm/cm² | Upon immersion in water Peel strength | Upon immersion in water Peeling properties | Water absorption degree (%) | Labeler applicability | Water resistance of image | Brimming of ink |
|---|---|---|---|---|---|---|---|---|---|---|---|
| Example 23 | A | — | E | A | 173 | 32.1 | ○ | 318 | ◎ | ○ | A |
| Example 24 | A | — | E | B | 173 | 21.5 | ◎ | 318 | ◎ | ○ | A |
| Example 25 | A | 7 | A | B | 171 | 28.6 | ◎ | 303 | ◎ | ○ | A |
| Example 26 | A | 5 | D | B | 175 | 23.0 | ◎ | 292 | ◎ | ○ | A |
| Example 27 | A | 8 | E | A | 191 | 24.2 | ◎ | 269 | ◎ | ○ | A |
| Example 28 | B | 8 | E | A | 254 | 19.4 | ○ | 204 | ◎ | ○ | B |
| Example 29 | A | 1 | E | B | 192 | 20.1 | ◎ | 256 | ◎ | ○ | A |
| Example 30 | A | 2 | E | B | 214 | 18.6 | ○ | 237 | ○ | ○ | B |
| Example 31 | B | — | B | B | 175 | 28.2 | ◎ | 273 | ◎ | X | A |
| Example 32 | B | — | C | B | 189 | 23.1 | ◎ | 320 | ◎ | ○ | A |
| Example 33 | C | — | E | B | 268 | 18.2 | ○ | 119 | ○ | ○ | B |
| Example 34 | B | 8 | E | B | 235 | 9.5 | ○ | 204 | Δ | ○ | B |
| Example 35 | C | 8 | E | B | 280 | 5.9 | ○ | 112 | X | ○ | B |
| Example 36 | B | 1 | A | A | 193 | 42.6 | Δ | 287 | Δ | X | A |
| Example 37 | B | 2 | E | B | 272 | 13.0 | ○ | 185 | ○ | ○ | B |
| Example 38 | B | 7 | B | B | 268 | 15.8 | ○ | 185 | ○ | ○ | B |
| Example 39 | B | 1 | E | B | 248 | 14.8 | ○ | 195 | ○ | ○ | B |

TABLE 4

| Examples or Comparative Examples | Support Type | Support Treating method | Type of ink-receiving layer | Type of adhesive layer | Wet internal bond strength g · cm/cm² | Upon immersion in water Peel strength | Upon immersion in water Peeling properties | Water absorption degree (%) | Labeler applicability | Water resistance of image | Brimming of ink |
|---|---|---|---|---|---|---|---|---|---|---|---|
| Comparative Example 1 | A | — | A | A | 91 | — | X | 420 | X | X | A |
| Comparative Example 2 | A | 11 | A | A | 100 | 54.6 | X | 385 | X | X | A |
| Comparative Example 3 | A | 10 | A | A | 103 | 52.9 | X | 388 | X | X | A |
| Comparative Example 4 | A | 3 | A | A | 98 | 52.1 | X | 400 | X | X | A |
| Comparative Example 5 | A | — | F | A | 108 | 47.5 | Δ | 371 | X | Δ | A |
| Comparative Example 6 | A | — | G | A | 104 | 49.2 | Δ | 394 | X | Δ | A |
| Comparative Example 7 | A | 10 | F | A | 115 | 45.7 | Δ | 352 | X | Δ | A |
| Comparative Example 8 | C | 2 | E | B | 335 | 12.6 | ○ | 110 | Δ | ○ | C |
| Comparative Example 9 | C | 8 | E | B | 323 | 5.3 | ○ | 147 | X | ○ | B |
| Comparative Example 10 | C | 7 | B | B | 325 | 10.2 | ○ | 105 | Δ | Δ | C |

Evaluation of the internal bond strength in a wet state

A test sample of a tack sheet for ink jet recording cut into a size of 2.5 cm ×12.5 cm, was immersed in water of 20° C. for 10 seconds. Then, excess water on the surface was wiped off, and the internal bond strength of the recording sheet was measured by a method in accordance with TAPPI USEFUL METHODS NO. 403.

Evaluation of the peel strength after immersion in water

A tack sheet for ink jet recording was immersed in water for 10 seconds. Then, excess water on the surface was wiped off, and the peel strength at 90° was measured by a tension (HTM-100 model) by a method in accordance with JIS Z0237/1980. The measurement was conducted with a sample width of 3 cm and at a peeling rate of 300 mm/min. A case where it was impossible to obtain data with respect to e.g. peeling of the adhesive layer from the recording sheet, was indicated by a symbol "--". Further, the peeling properties were observed and evaluated in accordance with the following evaluation standards.

◎: Excellent peeling properties

○: Good peeling properties

Δ: Slightly poor peeling properties (partial peeling between the recording sheet and the adhesive layer was observed.)

X: Poor peeling properties (peeling was observed between the recording sheet and the adhesive layer, or ply separation or rapture of the recording sheet took place).

Measurement of the amount of absorbed water and calculation of the water absorption degree An ink jet recording sheet cut into a size of 13 cm ×13 cm, was contacted with water so that the ink-receiving layer side is in contact with water in accordance with the method stipulated in JIS P8140, and the amount of water absorbed by the recording sheet after the contact for 10 seconds, was measured. Further, for the amount of the ink recordable per unit area, a solid pattern was recorded three times on a tack sheet for ink jet recording in a square of 15 cm×15 cm with a black ink of an ink jet printer (BJC 600J; manufactured by Canon Inc.), and the amount of ink required for the recording was taken as the amount of the ink recordable per unit area. The amount of ink required for recording by the printer used was 32.1 g /$m^2$. The water absorption degree of the recording sheet was represented by a value (%) obtained by dividing the amount of water absorbed by the recording sheet by the amount of ink required for recording.

Evaluation of the water resistance

Using an ink jet printer (BJC-820J; manufactured by Canon Inc.), a line with a width of 1 mm was printed with magenta ink, and one droplet of water was dropped on this line. After drying, the water resistance was evaluated by the degree of widening of the line.

○: No or little change observed

Δ: Widening of the line observed

X: Widening of the line and smudging of ink observed.

Evaluation of brimming of ink

Using the above ink jet printer, magenta ink and yellow ink were overprinted, and along the overprinted portion, cyan ink and yellow ink were overprinted, so that the overprinted portions were adjacent to each other, whereupon the boundary was evaluated in accordance with the following evaluation standards.

A: The boundary was clear, and no smudging of ink was observed.

B: The boundary line was observed as an intermittent black dotted line, but such did not impair the color effect or the sharpness.

C: The boundary line was observed as a continuous black line, and such impaired the color effect and the sharpness.

Evaluation of labeler applicability

Using an ink jet printer (Desk Writer 550C; manufactured by Hewlett-Packard Co.), a solid pattern was printed with a black ink on a tack sheet for ink jet recording in a square of 15 cm×15 cm, and on the printed portion, solid printing was applied twice by the same method. One end of the recorded solid printing portion was cut so that the release sheet would remain in a length of 5 cm, and the printed portion would be 5 cm×5 cm, whereupon the sample was bent while supporting the remaining release sheet and the opposite side with fingers. In this manner, the number of samples in which the edge portion of the recording sheet was smoothly peeled from the release sheet, was counted and evaluated as follows.

◎: All samples were smoothly peeled.

○: The number of samples which were not peeled or detached was one or two sheets out of 100 sheets.

Δ: The number of samples which were not peeled or detached was three or four sheets out of 100 sheets.

X: The number of samples which were not peeled or detached was at least five sheets out of 100 sheet.

Evaluation:

Here, Table 1 shows Examples for claims 1 to 5, Table 2 shows Examples for claims 6 to 9, Examples 23 to 33 in Table 3 represent Examples for claim 10 to 12, Examples 33 to 39 in Table 3 represent Examples for claims 13 to 16, and Table 4 shows Comparative Examples.

As shown in Table 1, by adjusting the internal bond strength of the recording sheet in a wet state at a level of from 120 to 320 g·cm/$cm^2$, it is possible to suppress ply separation or peeling failure due to an increase in the peel strength and to maintain the labeler applicability. Further, also with respect to the water resistance and quality of the image, the desired levels can be maintained. Further, as shown in Table 2, by adjusting the internal bond strength of the recording sheet in a wet state to a level of from 145 to 300 g·cm/$cm^2$ and the water immersion peel strength to a level of from 12 to 44 g/3 cm, it is possible to further improve the peeling properties in a wet state and the labeler applicability. And, as shown in Table 3, by adjusting the internal bond strength of the recording sheet in a wet state to a level of from 170 to 280 g·cm/$cm^2$, the water immersion peel strength to a level of from 18 to 38 g/3 cm and the water absorption degree to a level of at least 110 wt %, it is possible to impart to the recording sheet excellent properties as a tack sheet such as the peeling properties in a wet state and the labeler applicability and excellent properties as an ink jet recording sheet such as water resistance of the image, prevention of smudging of the printed image or staining of the background and the image reproducibility. Further, as shown by Examples 34 to 39 in Table 3, by adjusting the internal bond strength of the recording sheet in a wet state to a level of from 170 to 280 g·cm/$cm^2$ and the water absorption degree to a level of at least 110 wt %, it is possible to impart excellent properties as an ink jet recording sheet while maintaining the desired properties as a tack sheet such as the peeling properties in a wet state and the labeler applicability.

Further, by using a polycondensate of dicyandiamide or a polyvinyl amine as the cationic polymer, it is possible to improve the internal bond strength, the peel strength and the water resistance of the image, and it is possible to impart further improved properties to the tack sheet of ink jet recording. Further, by using a solvent-type adhesive for the adhesive layer, it will be possible to improve the peeling properties.

A shown in Table 4, when no cationic polymer is used for the support or the ink-receiving layer, it will not be possible to obtain the internal bond strength in a wet state which is capable of maintaining the peeling properties and the labeler applicability. Further, even when a cationic polymer is used, if the internal bond strength is outside the specified range, not only the peeling properties or the labeler applicability deteriorates, but also the printing properties such as image reproducibility will be adversely affected.

As is apparent from the foregoing, in the tack sheet for ink jet recording of the present invention, a cationic polymer is used in at least one of the support and the ink-receiving layer, and the internal bond strength and peel strength in a wet sate and the water absorption degree of the recording sheet are within the specified ranges, whereby it has good peeling properties even after recording with a water-color ink or even when moisture condensation or accidental absorption of water takes place, and since the ink absorptivity is secured, it is excellent in the image reproducibility. Further, by using a polycondensate of dicyandiamide or a polyvinyl amine as the cationic polymer and a solvent-type adhesive for the adhesive layer, it is possible to further improve the water resistance of the recording sheet and the recorded image and thus to obtain a tack sheet for ink jet recording having excellent peeling properties.

What is claimed is:

1. A tack sheet for ink jet recording, comprising (a) an ink jet recording sheet consisting of at least one ink-receiving layer containing a pigment formed on one side of a support and an adhesive layer formed on the other side of the support, and (b) a release sheet attached thereto by the adhesive layer to cover the adhesive layer, wherein a cationic polymer is contained or impregnated in at least one of the support and the ink-receiving layer, and the ink jet recording sheet has an internal bond strength of from 120 to 320 g·cm/cm$^2$ as measured in a wet state after being immersed in water at 20° C. for 10 seconds, in accordance with TAPPI USEFUL METHODS NO. 403.

2. The tack sheet for ink jet recording according to claim 1, wherein the water immersion peel strength between the adhesive layer of the ink jet recording sheet in a wet state and the release sheet is from 6 to 50 g/3 cm, in accordance with JIS Z0237-1980.

3. The tack sheet for ink jet recording according to claim 1, wherein the water absorption degree of the ink jet recording sheet is at least 110 wt % of the weight of the ink recordable per unit area, in accordance with JIS P8140.

4. The tack sheet for ink jet recording according to claim 1, wherein the cationic polymer is at least one member selected from the group consisting of a polycondensate of dicyandiamide and a polyvinyl amine.

5. The tack sheet for ink jet recording according to claim 1, wherein the adhesive layer is composed of a solvent-type adhesive.

6. The tack sheet for ink jet recording according to claim 1, wherein said cationic polymer is contained or impregnated in said support in an amount sufficient to provide a cationic charge per unit area of at least 0.2 meq/m$^2$.

7. The tack sheet for ink jet recording according to claim 6, wherein said cationic charge per unit area is at least 0.5 meq/m$^2$.

8. The tack sheet for ink jet recording according to claim 1, wherein said cationic polymer is contained in said ink-receiving layer in amount sufficient to provide a cationic charge per unit area of at least 0.5 meq/m$^2$.

9. The tack sheet for ink jet recording according to claim 8, wherein said cationic charge per unit area is at least 0.8 meg/m$^2$.

10. The tack sheet for ink jet recording according to claim 1, wherein said cationic polymer is selected from the group consisting of a polyalkylene-polyamide, a polyalkylene polyurea, a polyamide polyurea, a polyamide epoxy resin, a reaction product of a polyamide epoxy resin with an aldehyde, with an alkylating agent or with a ring-opened polymer of ethyleneimine, a homopolymer of a cationic vinyl polymer, a copolymer of a cationic vinyl polymer with a copolymerizable monomer, a homopolymer of an N-vinylamide monomer, a copolymer of an N-vinylamide monomer and a copolymerizable monomer, a Mannich reaction product having ammonia a primary amine or a secondary amine reacted with formaldehyde and a polymer having an active hydrogen, a reaction product of a cationic agent with a polymer having an active hydrogen, a reaction product of ammonia, an amine or epihalohydrin with a polymer having an active hydrogen, and cross-linked copolymers thereof obtained by cross-linking said cationic polymer and hydrolyzed chitin with a cross-linking agent.

11. The tack sheet for ink jet recording according to claim 1, consisting essentially of said ink jet recording sheet and said release sheet.

12. The tack sheet for ink jet recording according to claim 1, consisting of said ink jet recording sheet and said release sheet.

13. A tack sheet for ink jet recording, comprising (a) an ink jet recording sheet consisting of at least one ink-receiving layer containing a pigment formed on one side of a support and an adhesive layer formed on the other side of the support, and (b) a release sheet attached thereto by the adhesive layer to cover the adhesive layer, wherein a cationic polymer is contained or impregnated in at least one of the support and the ink-receiving layer, the ink jet recording sheet has an internal bond strength of from 145 to 300 g·cm/cm$^2$ as measured in a wet state after being immersed in water at 20° C. for 10 seconds, in accordance with TAPPI USEFUL METHODS NO. 403, and the water immersion peel strength between the adhesive layer and the release sheet is from 12 to 44 g/3 cm, in accordance with JIS Z0237/1980.

14. The tack sheet for ink jet recording according to claim 13, wherein the water absorption degree of the ink jet recording sheet is at least 110 wt % of the weight of the ink recordable per unit area, in accordance with JIS P8140.

15. The tack sheet for ink jet recording according to claim 13, wherein the cationic polymer is at least one member selected from the group consisting of a polycondensate of dicyandiamide and a polyvinyl amine.

16. The tack sheet for ink jet recording according to claim 13, wherein the adhesive layer is composed of a solvent-type adhesive.

17. A tack sheet for ink jet recording, comprising (a) an ink jet recording sheet consisting of at least one ink-receiving layer containing a pigment formed on one side of a support and an adhesive layer formed on the other side of the support, and (b) a release sheet attached thereto by the adhesive layer to cover the adhesive layer, wherein a cationic polymer is contained or impregnated in at least one of the support and the ink-receiving layer, the ink jet recording sheet has an internal bond strength of from 170 to 280 g·cm/cm$^2$ as measured in a wet state after being immersed in water at 20° C. for 10 seconds, in accordance with TAPPI USEFUL METHODS NO. 403, the water immersion peel strength between the adhesive layer and the release sheet is from 18 to 38 g/3 cm, in accordance with JIS Z0237/1980, and the water absorption degree of the ink jet recording sheet is at least 110 wt % of the weight of the ink recordable per unit area, in accordance with JIS P8140.

18. The tack sheet for ink jet recording according to claim 17, wherein the cationic polymer is at least one member selected from the group consisting of a polycondensate of dicyandiamide and a polyvinyl amine.

19. The tack sheet for ink jet recording according to claim 17, wherein the adhesive layer is composed of a solvent-type adhesive.

20. A tack sheet for ink jet recording, comprising (a) an ink jet recording sheet consisting of at least one ink-receiving layer containing a pigment formed on one side of a support and an adhesive layer formed on the other side of the support, and (b) a release sheet attached thereto by the adhesive layer to cover the adhesive layer, wherein a cationic polymer is contained or impregnated in at least one of the support and the ink-receiving layer, the ink jet recording sheet has an internal bond strength of from 170 to 280 g·cm/cm$^2$ as measured in a wet state after being immersed in water at 20° C. for 10 seconds, in accordance with TAPPI USEFUL METHODS NO. 403, and the water absorption degree of the ink jet recording sheet is at least 110 wt % of the weight of the ink recordable per unit area, in accordance with JIS P8140.

21. The tack sheet for ink jet recording according to claim 20, wherein the water immersion peel strength between the adhesive layer of the ink jet recording sheet in a wet state and the release sheet is from 6 to 50 g/3 cm, in accordance with JIS Z0237/1980.

22. The tack sheet for ink jet recording according to claim 20, wherein the cationic polymer is at least one member selected from the group consisting of a polycondensate of dicyandiamide and a polyvinyl amine.

23. The tack sheet for ink jet recording according to claim 20, wherein the adhesive layer is composed of a solvent-type adhesive.

* * * * *